US005810024A

United States Patent [19]

Crites

[11] Patent Number: 5,810,024

[45] Date of Patent: Sep. 22, 1998

[54] TOUCH-UP KIT

[76] Inventor: Barry R. Crites, 10 Prince Pl., Newburyport, Mass. 01950

[21] Appl. No.: 935,606

[22] Filed: Sep. 23, 1997

[51] Int. Cl.[6] ..... A45D 7/00

[52] U.S. Cl. ..... 132/210; 132/208; 132/270

[58] Field of Search ..... 132/210, 208, 132/207, 200, 270, 204, 205, 221, 212, 222; 206/223, 574, 575, 581, 823

[56] References Cited

U.S. PATENT DOCUMENTS

| | | | |
|---|---|---|---|
| 3,548,842 | 12/1970 | McCall | 132/222 |
| 5,007,443 | 4/1991 | Fulgoni | 132/270 |
| 5,146,937 | 9/1992 | Lefebvre | 132/208 |
| 5,349,970 | 9/1994 | Razzouq | 132/208 |
| 5,433,225 | 7/1995 | Liggett et al. | 132/208 |
| 5,551,455 | 9/1996 | Spatola | 132/212 |
| 5,584,309 | 12/1996 | DeBeneditis et al. | 132/208 |

*Primary Examiner*—Gene Mancene
*Assistant Examiner*—Philogene Pedro
*Attorney, Agent, or Firm*—John P. McGonagle

[57] ABSTRACT

A kit comprised of a series of strips of impervious, thin plastic material interleaved with strips of the same size and shape made of tissue paper, a container of protein gel conditioner, and an optional perm board. The interleaved strips are assembled into a pack. The traditional tissue end papers used when perming hair has been replaced in the present invention with "end papers" made of a thin plastic film. The plastic end papers are used to cover hair that has been previously permed. In doing so, only the "new growth", i.e., the hair growth which is virgin hair, gets permed without reperming and damaging previously permed hair. The previously permed hair which is placed under the plastic wrap is coated with a liquid protein to further ensure protection against the perming solution.

8 Claims, 5 Drawing Sheets

FIG. 4
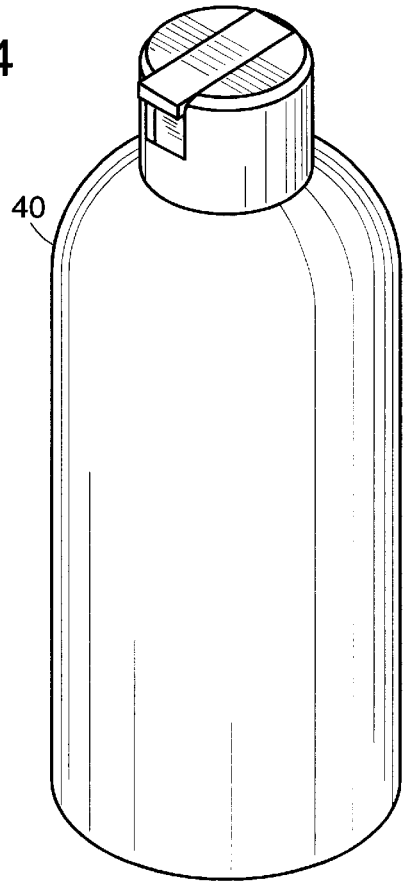
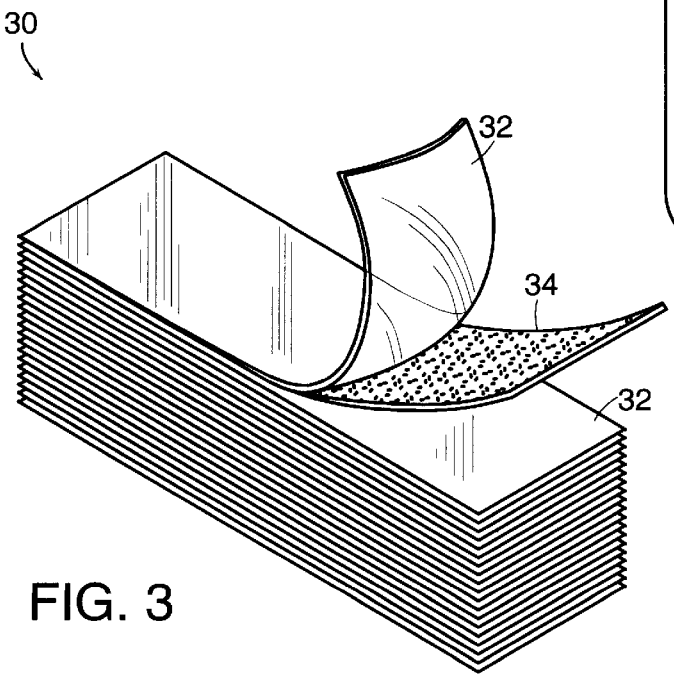
FIG. 3

TOUCH-UP KIT

BACKGROUND OF THE INVENTION

This invention relates to the chemical processing of hair, and more particularly to a kit and method for protecting permanently waved hair during touch-up and root permanent waving processes from damage caused by permanent wave or hair straightening solutions.

Since their introduction in the 1940's, cold permanent waving has become one of the more widespread procedures used in both beauty salons and by consumers at home. In permanent waving, tresses of hair are wound from the ends toward the scalp in what is called a croquignole winding. When the entire head of hair has been so wound, a chemical solution is applied to each curl. This solution contains a reducing agent which breaks the disulfide linkages present in the keratin of the hair. The broken disulfide linkages reset into the shape imparted by the curling roller. After a period of time, the wound hair is rinsed and neutralized by an oxidizing chemical which, by reforming the disulfide linkages, reshapes the hair shafts in the new configuration. The result is the effect of naturally curly hair in place of straight hair. The result of the process also gives the illusion of fuller hair to people with thin hair, and it roughens the hair shaft to add body to fine limp hair.

To facilitate the rolling of the tresses and to ensure the ends are kept tightly positioned for uniform curling, end wraps are used. Traditional end wraps made of tissue are used to straighten and position the hair for efficient rolling onto the wave rods. The textures of the rolling paper absorbs the curling and neutralizing fluids to saturate the hairs. While they do function satisfactorily to facilitate rolling of the hair tresses, these end wraps tend to collect and concentrate the waving solutions, adding to the over-exposure of the ends to these chemicals.

Despite the name of the process, permanent waving is not permanent. As the hair grows out, that part of the shaft that is the new growth displays its natural characteristics of straightness or fine texture. As a result, the permanent waving process must be repeated at intervals to maintain the desired hair characteristics or style. The problem with repeating the procedure is that previously permed hair is again exposed to the harsh permanent wave solutions and is subject to damage by them. Because the new growth (the roots) and the previously permed, chemically treated hair do not have the same porosity and are not in the same condition, when the entire hair shaft is exposed to the permanent wave chemicals, the new growth perms well while the remainder of the hair shaft becomes damaged from the repetitive chemical exposure.

In addition, the use of hair bleaches or colorants and other exposure to harsh environmental conditions, weakens hair making it more susceptible to damage by chemical perming agents.

Some earlier attempts have been made to limit the damage caused by this repeated exposure to permanent wave or hair straightening solutions.

U.S. Pat. No. 3,367,345, issued Feb. 6, 1968 to O. L. Riley, teaches the use of a stretchable, non-porous crepe paper end paper for use in procedures for straightening very curly hair. This process uses chemicals similar to those used in the permanent waving process. To protect the previously straightened hair, the ends are encased in the end wrap of this disclosure, but are rolled only to the point where the new growth meets the previously straightened hair. The stretchable quality of the crepe paper, however, makes it difficult to control the manipulation and use of it.

U.S. Pat. No. 3,465,759, issued Sep. 9, 1969 to J. W. Haefele, describes the use of an impervious plastic foam as the material for end wraps that are intended to be reusable. The characteristics of the foamed material are critical to this disclosure and its complex production is described in great detail. The patent does not disclose the use of a non-foamed plastic sheet as an end wrap.

U.S. Pat. No. 3,548,842, issued Dec. 22, 1970 to B. P. McCall, describes a single end wrap composed of two materials, one porous and absorbent, the other imperforate and non-absorbent. These two materials are joined at their ends to form a single end wrap. This requires the stylist to exercise considerable skill in positioning this end wrap so that the joint of the two materials is precisely at the point where the previously-permed part of the tress and the new growth to be permed are located. Otherwise, new growth may not be exposed to the permanent solutions or previously permed hair will not be properly protected against exposure to these harsh chemicals.

U.S. Pat. No. 3,960,156, issued Jun. 1, 1976 to R. L. Thompson, teaches a single piece of perforated plastic film as the end wrap, but it is attached to the curling rod and is intended to be reused. One of its purposes is to eliminate the problem of disposal of the used end wraps and to minimize difficulty in manipulating loose end papers. Plastic is required for this device because it is intended to be reused, but Thompson does not teach any means for protecting the ends of the hair tress.

In U.S. Pat. No. 4,632,132, issued Dec. 30, 1986 to W. G. Bustance et al, there is disclosed an end wrap laminate wherein two sheets, one impermeable the other porous, are joined by adhesive throughout their entirety. The porous sheet is impregnated with a waving solution counteractant and is also impregnated with a hair conditioner providing both a physical barrier and chemical counteractant to the permanent waving solutions. However, the manufacture of these end wraps is complicated and simultaneously counteracting the permanent wave chemicals and conditioning the hair is difficult to achieve.

SUMMARY OF THE INVENTION

In view of the forgoing disadvantages inherent in both the traditional method and attempts to improve on it, the present invention provides an improved means and method for protecting previously-permed or straightened hair during a subsequent chemical procedure. As such, the general purpose of the present invention, which will be described subsequently in greater detail is to provide a simple, efficient, convenient to use, flexible, impervious, and inexpensive means for wrapping previously permed hair tresses.

Another object of the present invention is to provide a means and method by which previously permed hair tresses can be isolated from the rest of the tress to be permed.

A further object of the present invention is to provide for applying a protein conditioner to further protect the previously permed hair tresses during the permanent waving or straightening process.

A still further object of the present invention is to provide a means and method for protecting previously treated hair tresses during the process of retreating very naturally curly hair.

It is still another object of the present invention to provide a means and method by which a stylist might create innovative hair styles by using selective perming or straightening techniques.

To attain these objects, the present invention provides a kit comprised of a series of strips of impervious, thin plastic material interleaved with strips of the same size and shape made of tissue paper, a container of protein gel conditioner, and an optional perm board. The interleaved strips are assembled into a pack. The traditional tissue end papers used when perming hair has been replaced in the present invention with "end papers" made of a thin plastic film. The plastic end papers are used to cover hair that has been previously permed. In doing so, only the "new growth", i.e., the hair growth which is virgin hair, gets permed without reperming and damaging previously permed hair. The previously permed hair which is placed under the plastic wrap is coated with a liquid protein to further ensure protection against the perming solution.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

FIG. 3 is a perspective view of a stack of touch-up papers used in the present invention.

FIG. 4 is a perspective view of a protein gel applicator used in the present invention.

DETAILED DESCRIPTION OF THE INVENTION

Figure 1:
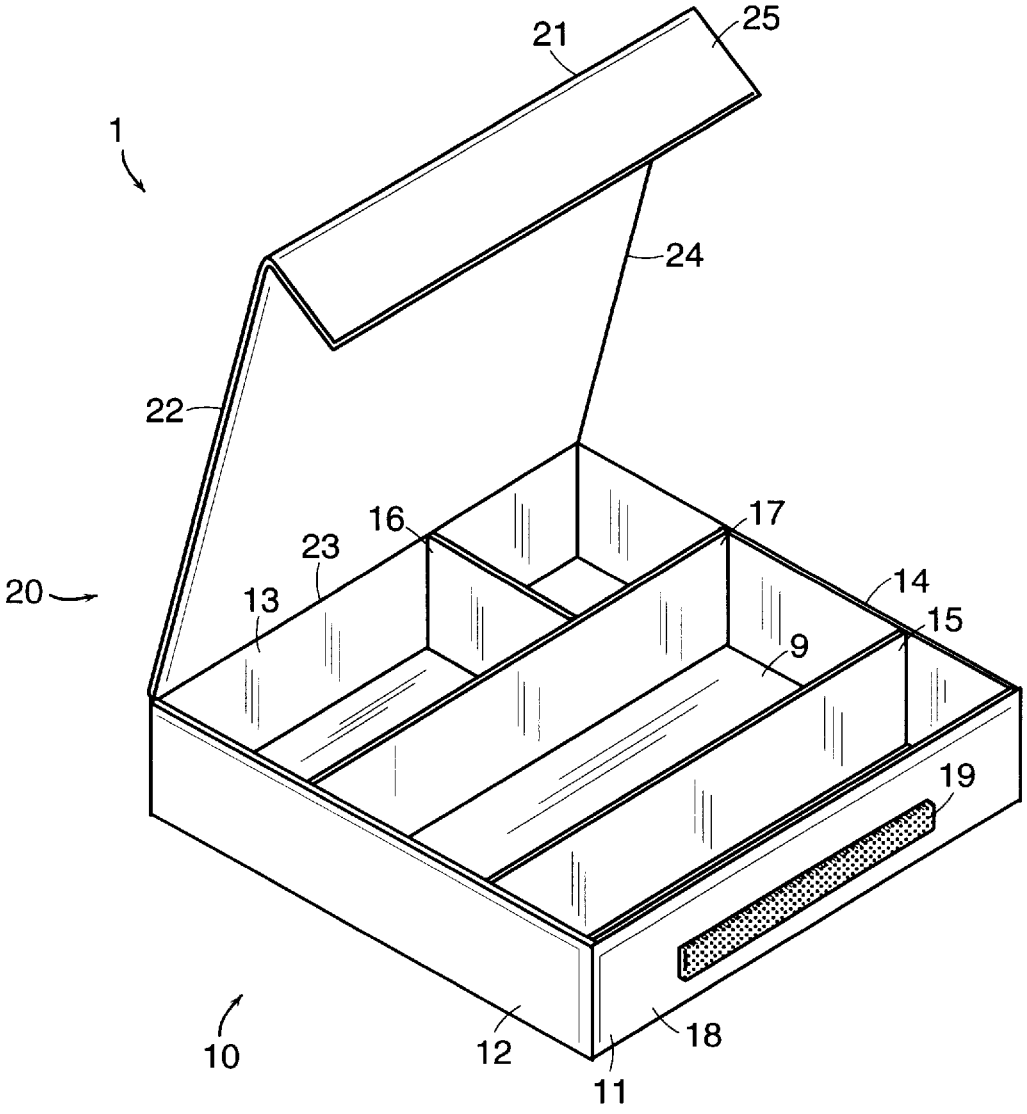
FIG. 1 is a perspective view of a touch-up kit according to the present invention.
Figure 2:
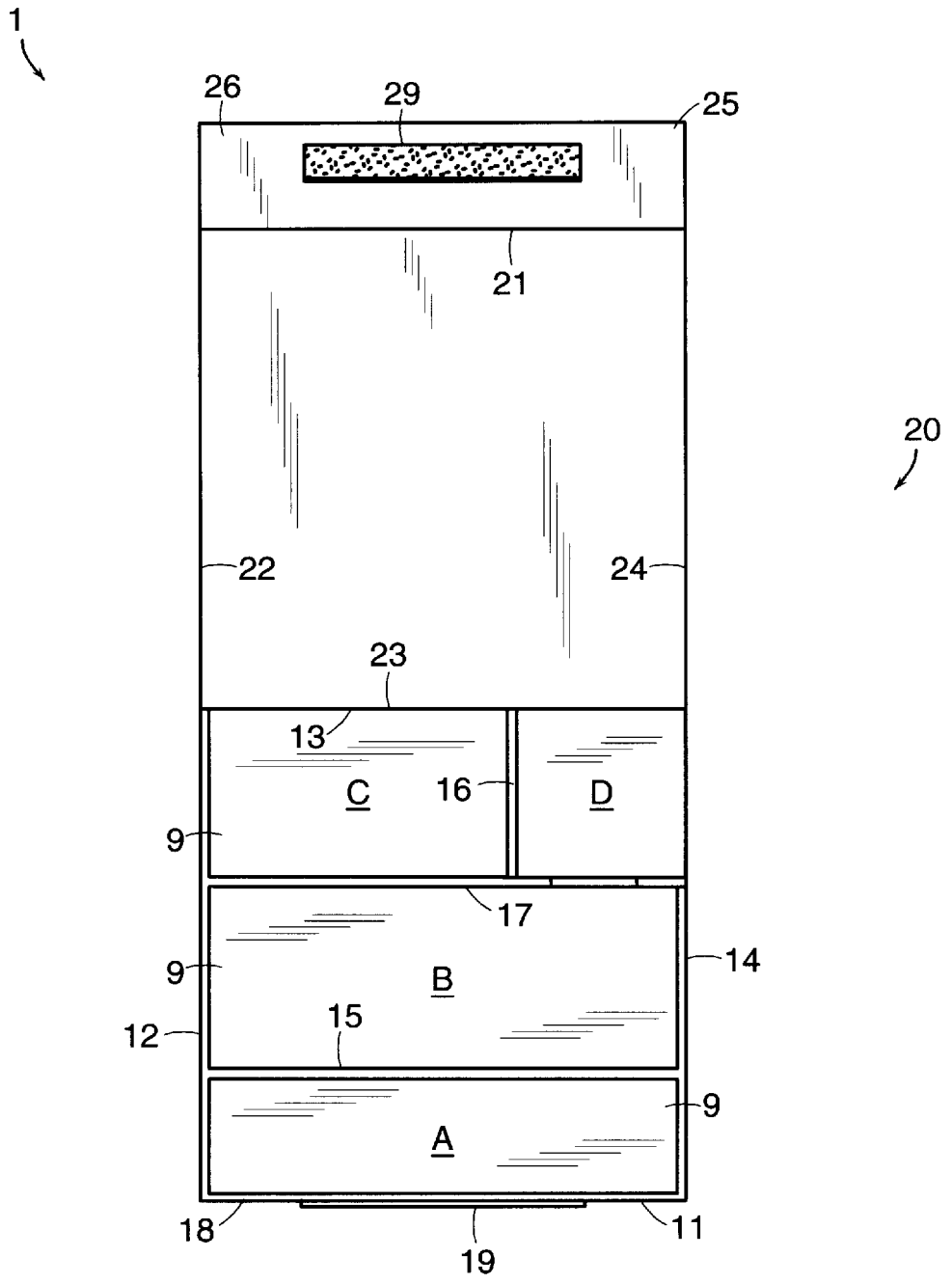
FIG. 2 is a top plan view of the kit of FIG. 1 with its cover member open.

Referring to the drawings in detail wherein like elements are indicated by like numerals, there is shown a touch-up kit incorporating the features of the present invention. Reference numeral 1 refers to the kit storage box 1. The box 1 is made out of a sturdy, lightweight material such as cardboard or plastic and has a generally rectangular base member 10 and corresponding cover member 20. The base member 10 is comprised of a substantially parallel front 11 and rear 13 walls, substantially parallel side walls 12 and 14, and a flat bottom 9 extending from the front 11 to rear 13 walls and from side wall 12 to side wall 14. The base member 10 also has two divider walls 15 and 17 parallel to the front 11 and rear 13 walls extending from one side wall 12 to the other 14. The rearward divider wall 17 has a small divider wall 16 extending rearward to the rear wall 13 substantially parallel to the side walls 12 and 14. The base member walls 11–17 form four compartments A, B, C and D. Other divider walls may be added or subtracted to increase or decrease the number of compartments formed thereby.

The cover member 20 is generally flat and has four edges 22, 24, 21, and 23 which correspond to the base member sides 12 and 14, front 11 and rear 13 walls. The cover member rear edge 23 is pivotally hinged along its length to the top edge of the base member rear wall 13. The cover member front edge 21 terminates in a downwardly extending flap 25 with a hook and pile fastener strip 29, commonly sold under the Velcro trademark, on the flap's inner face 26. A corresponding Velcro strip 19 is positioned along the base member front wall outer face 18. When the cover member flap 25 is pressed against the base member front wall outer face 18, both Velcro strips 19 and 29 interlock.

FIG. 3 illustrates a stack 30 of plastic strips 32 interleaved with strips of paper 34. The purpose of the paper strips 34 is to keep the plastic strips 32 separated. This prevents the plastic strips 32 from clinging together and makes it easier for the stylist to remove the plastic strips 32 from the stack 30. In the preferred embodiment, the material used for the plastic strips 32 is a thin plastic film, such as a commercial cellophane wrap. Each plastic strip 32 is fourteen inches long and two and one-half inches wide, but other sizes and shapes can be used for different lengths of hair and to create a variety of hairstyles. The paper strips 34 are a light weight, flimsy material such as tissue paper.

FIG. 4 illustrates a protein gel applicator 40. The applicator 40 provides the stylist with a means for coating previously permed hair 64 which has been placed on one of the plastic strips 32 with a protein gel 42. The purpose of the gel 42 is to insure that no chemical, i.e., perming solution, comes in contact with the previously permed hair 64. Traditional conditioners, while providing some protection to the previously permed hair 64, have a slippery texture which make wrapping the hair 64 in a plastic strip 32 difficult. By enhancing a conditioner with protein and making it into a gel, the conditioner acquires a thicker consistency and texture. Protein conditioners become more dense and tacky as they are exposed to air because of moisture evaporation. This will cause a rolled plastic strip 32 holding previously permed hair 64 to adhere to itself making it virtually "leak proof" and thereby making it impossible for a perm solution to penetrate to the previously permed hair 64. A second advantage is that hair is essentially made up of protein. The protein bonds of the hair are responsible for keeping hair strong which enables it to hold moisture, which in turn makes hair soft, shiny and resilient. When hair is chemically exposed these bonds are weakened and stressed, thereby creating unhealthy hair. The protein gel 42 of the instant invention rejoins these protein bonds and makes protein available to be absorbed into the previously permed hair, thereby making the hair shinier and healthier.

Figure 5:
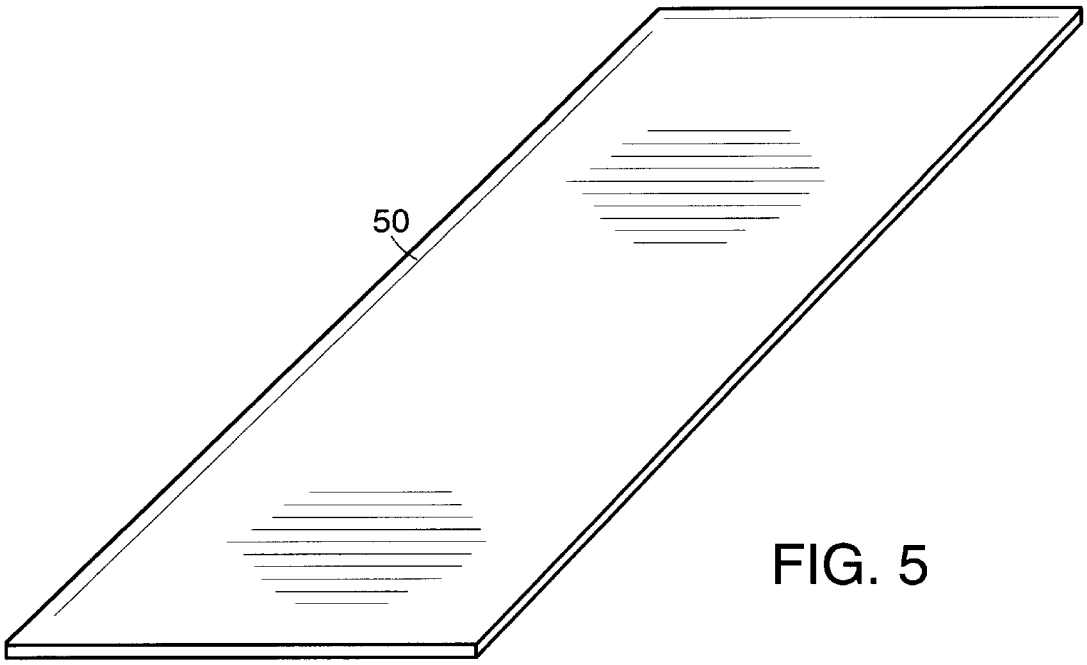
FIG. 5 is a perspective view of a perm board used in the present invention.

The optional perm board 50 illustrated in FIG. 5 provides a work surface for laying out a plastic strip 32 in preparation for placing previously permed hair 64 thereon. After the protein gel 42 has been applied to the hair 64, the hair 64 is wrapped in the plastic strip 32 and rolled up. The board 50 provides a flat surface making the entire procedure simpler, faster and more precise.

Compartment A holds the stack 30. Compartment B holds the optional perm board 50. Compartment C holds the protein gel applicator 40. Compartment D is available for miscellaneous pins and other sundries.

Figure 6:
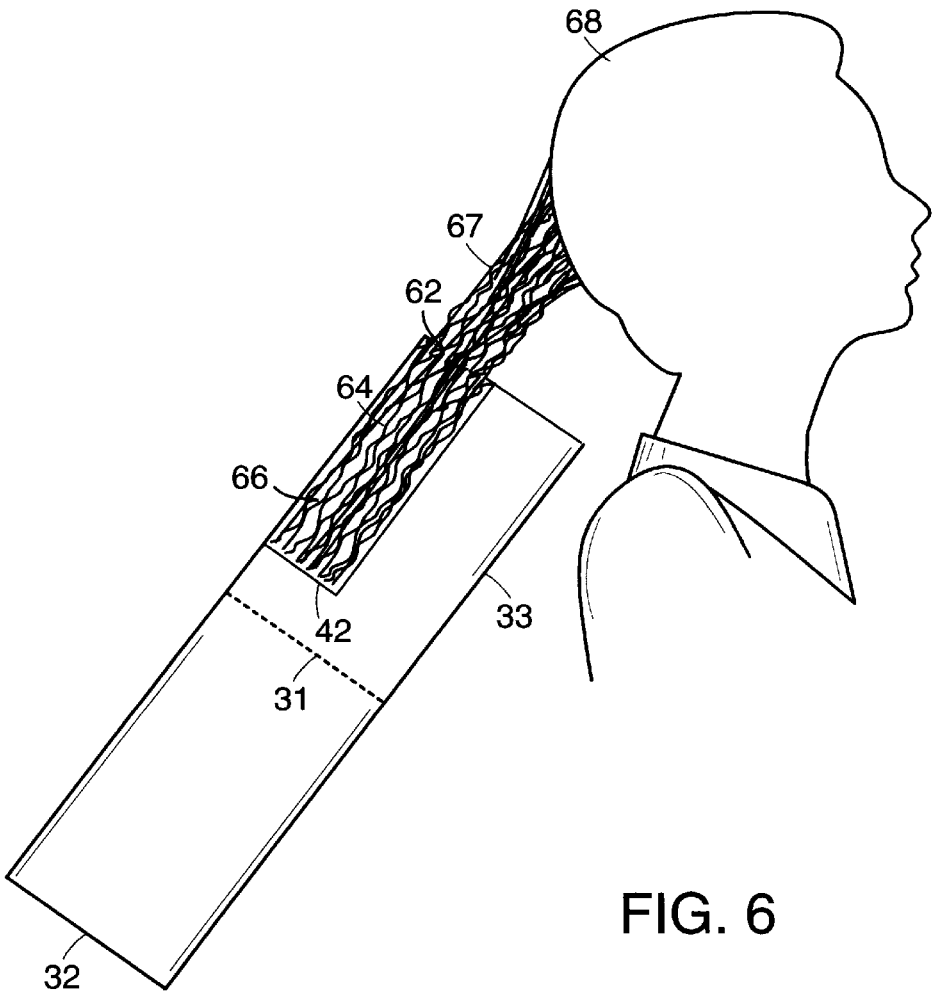
FIG. 6 is a diagrammatic representation of the method of using one of the touch-up strips illustrated in FIG. 3.
Figure 7:
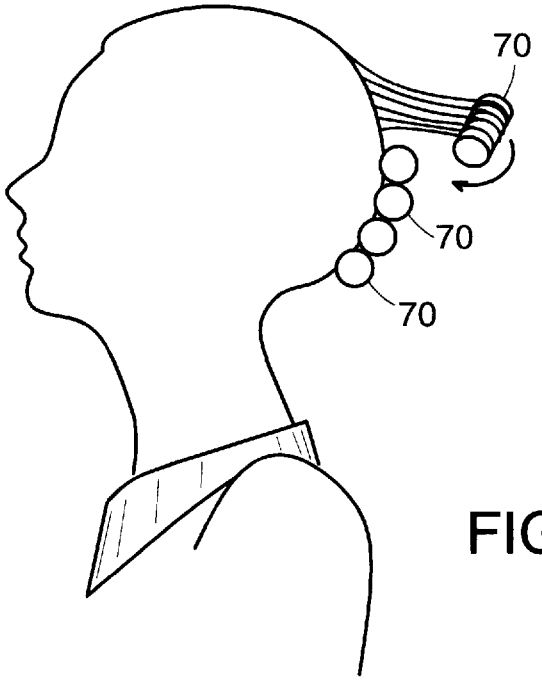
FIG. 7 illustrates the croquignole winding of hair tresses using the method of the present invention.

In use, and referring to FIG. 6, the stylist separates a section of the patron's 60 hair into a tress 62. The stylist places the previously permed portion 64 of the tress 62 onto an upper portion 33 of the plastic strip 32. The stylist next brushes or otherwise coats the part 64 of the tress 62 on the plastic strip 32 with a protein gel 42. The gel 42 consists primarily of a hydrolyzed animal protein in a gel form. Because the protein gel 42 is impermeable to the permanent wave solutions, it further reduces contact between the previously permed hair 64 and the water soluble curling fluids. The stylist next folds the plastic strip 32 at the phantom line 31 so that the plastic strip lower portion 35 covers the coated portion 64 of the tress 62. The hair 60 is then wound to the scalp 68 in a croquignole on a perm rod or roller 70 as shown in FIG. 7. The process is repeated over the entire head or for selected sections of the hair.

Previously permed hair is thus excluded from the normal perming process and chemicals enabling the old hair to remain stable and healthy without being damaged.

Figure 8:
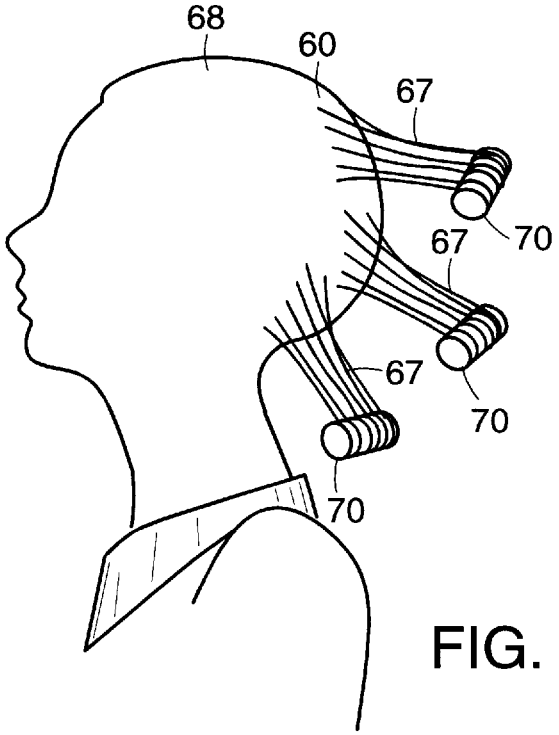
FIG. 8 illustrates the method of employing the method of this disclosure for purposes of straightening hair.

In an alternative embodiment of the invention, and referring again to FIG. 6, the previously straightened end 66 of a tress 62 of hair 60 is placed on the upper part 33 of a plastic strip 32. The end 66 of the tress 62 is placed onto the upper part 33 of a plastic strip 32 and is treated with protective protein gel 42. The stylist folds the plastic strip 32 at the phantom line 31 to cover the lower portion 66 of the tress 62. The hair is then rolled but only to the point where the new growth 67 meets the previously treated hair 66 as shown in FIG. 8. The new growth 67 is then treated with straightening chemicals while the previously treated hair 66 remains protected.

It is understood that the above-described embodiments are merely illustrative of the application. Other embodiments, for example the size of the plastic strips 32 might be modified to accommodate the needs of different hairstyles and lengths of hair, may be readily devised by those skilled in the art which will embody the principles of the invention and fall within the spirit and scope thereof.

I claim:

1. A touch-up kit for use in protecting permanently waved hair during touch-up and root permanent waving processes, comprising:

a covered box with a plurality of compartments;

a plurality of strips of impervious, thin plastic material contained within at least one of said compartments;

a plurality of paper strips interleaved with said plastic strips and having of the same size and shape as said plastic strips;

a conditioner applicator container contained within another of said compartments; and a protein gel conditioner contained within said conditioner container.

2. A touch-up kit as recited in claim 1, further comprising:

a perm board contained within another of said compartments.

3. A touch-up kit as recited in claim 2, wherein:

said protein gel conditioner is a hydrolyzed animal protein in a gel form.

4. A touch-up kit as recited in claim 3 wherein said box is comprised of:

a generally rectangular base member having substantially parallel front and rear walls, substantially parallel side walls, a flat bottom extending from front wall to rear wall and from side wall to side wall, forward and rearward divider walls parallel to said front and rear walls extending from one side wall to the other side wall, and a small divider wall extending from said rearward divider wall to said rear wall, wherein said walls form a plurality of compartments; and a corresponding, generally flat, cover member having four edges which correspond to the base member side, front and rear walls, wherein the cover rear edge is pivotally hinged along said cover rear edge length to the top of the base member rear wall.

5. A touch-up kit as recited in claim 4 wherein:

said cover member front edge terminates in a downwardly extending flap with fastening means for attachment to fastening means on the exterior of the base member front wall.

6. A touch-up kit as recited in claim 5 wherein:

said paper strips are a light weight, flimsy material.

7. A touch-up kit as recited in claim 6 wherein:

said strips of impervious, thin plastic material are made from a thin plastic film, and have a lower portion and upper portion separated by a phantom line.

8. A method for protecting permanently waved hair during touch-up and root permanent waving processes from damage caused by permanent wave or hair straightening solutions, utilizing a touch-up kit containing a plurality of strips of impervious, thin plastic film with tissue paper strips interleaved between said plastic strips and having of the same size and shape as said plastic strips, said plastic strips having a lower portion and an upper portion separated by a phantom line, an applicator containing a protein gel conditioner, and a perm board, comprising the steps of:

separating said waved hair into a tress;

placing the previously waved portion of the tress onto the upper portion of one of said plastic strips;

applying said protein gel to the portion of the tress on the upper portion of said plastic strip;

folding the plastic strip at said phantom line so that the plastic strip lower portion covers the coated portion of the tress;

rolling the entire tress in a croquignole winding to the scalp; and repeating the above steps over the entire head or for selected sections of the hair.

* * * * *